United States Patent [19]

Vickers

[11] 4,342,425

[45] Aug. 3, 1982

[54] CAVITATION NOZZLE ASSEMBLY

[75] Inventor: Geoffrey W. Vickers, Vancouver, Canada

[73] Assignee: Her Majesty the Queen in right of Canada, as represented by the Minister of National Defence, Ottawa, Canada

[21] Appl. No.: 178,603

[22] Filed: Aug. 15, 1980

[30] Foreign Application Priority Data

Apr. 10, 1980 [CA] Canada ..... 350120

[51] Int. Cl.[3] ..... B05B 7/06

[52] U.S. Cl. ..... 239/424; 239/288.5; 175/67

[58] Field of Search ..... 239/423, 424, 499, 584, 239/596, 601, 288.5; 134/1; 175/67, 340, 422, 393; 299/14, 17, 37

[56] References Cited

U.S. PATENT DOCUMENTS

| | | | |
|---|---|---|---|
| 3,572,839 | 3/1971 | Okape | 175/67 |
| 3,807,632 | 4/1974 | Johnson, Jr. | 239/424 |
| 4,171,091 | 10/1979 | Hardeveld et al. | 239/424 |
| 4,193,635 | 3/1980 | Thiruvengadam et al. | 299/17 |

*Primary Examiner*—James B. Marbert

*Attorney, Agent, or Firm*—William R. Hinds

[57] ABSTRACT

A cavitation nozzle assembly is described for discharging a high velocity jet of liquid with cavitation bubbles therein. The nozzle assembly includes a supply chamber having an upstream portion divergent in a downstream direction, a downstream portion convergent in the downstream direction, and a central section of generally constant cross-sectional area. The convergent portion is conical in form and encloses an angle of about 65°–90°, more preferably 75° to 85° and optimally about 80°. The convergent portion converges to a discharge orifice having a circular cross-section with a diameter in the range from about 1.2 mm to about 4.0 mm. In a more preferred form, liquid distribution means are provided adjacent to the discharge orifice, configured to produce a shroud of said liquid at low pressure surrounding the high velocity jet. In another preferred embodiment, the central section of the supply chamber has a diameter from about 12 mm to about 50 mm. Still more preferably, the convergent portion and discharge orifice are provided in a disc-like nozzle element, preferably releasably secured to define a downstream end of the supply chamber. In yet another preferred embodiment the nozzle element has a plurality of said discharge orifices. In a further preferred embodiment positioning means are provided to abut a surface being treated, and causing the high velocity jet to impinge the surface at an angle from about 30° to about 60°.

17 Claims, 12 Drawing Figures

△ 1.6 mm CONICAL NOZZLE, (ℓ/D=1.8), UPSTREAM BORE DIA=25mm
● 1.6 mm ℓ/D = 4 CONICAL NOZZLE
■ 1.6 mm UPSTREAM BORE DIA. = 8mm CONICAL NOZZLE
○ 1.6 mm HEMISPHERICAL NOZZLE
▼ 1.6 mm LOGARITHMIC NOZZLE

△ 1.6mm CONICAL NOZZLE ($\ell$/D=1.8). UPSTREAM BORE DIA=25mm
● 1.6 mm $\ell$/D = 4 CONICAL NOZZLE
■ 1.6 mm UPSTREAM BORE DIA = 8mm CONICAL NOZZLE.
○ 1.6 mm HEMISPHERICAL NOZZLE
▼ 1.6 mm LOGARITHMIC NOZZLE 80° CONICAL NOZZLE AT 20 MPa (5 MIN. TEST)

CAVITATION NOZZLE ASSEMBLY

This invention relates to a cavitation nozzle apparatus adapted for cleaning a surface of rust, paint, barnacles or other such material. More particularly, the cavitation nozzle apparatus of this invention includes a conical nozzle enclosing an angle in the range of about 65° to 90°, more preferably from 75° to about 85°, and including features providing significantly improved cleaning action.

BACKGROUND OF THE INVENTION

High velocity jets of water in the form of discrete droplets, or with cavitation bubbles therein are being used increasingly for surface cleaning operations. Such operations include the removal of paint or other protective film from roads, structures, stone or brick facades, removing grease, clinker or chemical products such as rust from tanks, pipes heat exchangers or the like. It is also often necessary to clean badly corroded metal surfaces to a white metal finish, or to remove barnacles and marine growth from ships hulls, tower legs or the like that are normally under water.

With nozzles that use discrete water droplets, a fairly large stand-off distance is used, i.e., the distance between the nozzle orifice and the work surface. The physical impact of such droplets on a target surface causes a comples pattern of intense transient stresses. These stresses cause break-down and removal of surface material. For removing the most resistant materials, the use of vapour filled cavities, i.e. cavitation bubbles was proposed. The collapse of vapour-filled cavities also generates intense transient stresses which can be caused to remove surface material. The collapse of these cavities has the potential, for a given jet velocity, of generating stresses even higher than those obtainable by droplet impact.

To date, cavitation nozzles have had limited commercial development. Further, researchers in this art have had conflicting views as to the superiority of either form of nozzle over the other. Here, the reader is referred to papers such as:

(a) Conn, A. F., Rudy, S. L., and Mehta, G. D., "Development of a cavijet system for removing marine fouling and rust," Proc. 3rd International Symposium on Jet Cutting Technology: Paper G4, organized by Brit. Hydromech. Res. Assoc., Chicago, U.S.A., May 11–13, 1976.

(b) Beutin, E. G., Erdmann-Jesnitzer, F., and Louis, H., "Influence of cavitation bubbles in cutting jets," Proc. 2nd International Symposium on Jet Cutting Technology: Paper D3, organised by Brit. Hydromech. Res. Assoc., Cambridge, Apr. 2–4, 1974.

(c) Lichtarowicz, A., "Experiments with cavitating jets," Proc. 2nd International Symposium on Jet Cutting Technology: Paper D11, Apr. 2–7, 1974.

(d) Thiruvengadam, A., "The concept of erosion strength," Erosion by Cavitation or Impingement, ASTM STP 408, Am. Soc. Testing Mats., 1967 pg. 22.

(e) Hammitt, F. G., "Collapsing bubble damage to solids," Cavitation state of knowledge, ASME, 87–102, 1969.

A reader is also directed to Canadian and U.S. Pat. Nos. 967,940 of May 20, 1975 and 3,713,699, respectively, which issued to Hydronautics Incorporated (Virgil E. Johnson, Jr.), and U.S. Pat. No. 3,572,839 which issued in March, 1971 to Okabe. These patents show prior art constructions which embody certain advantageous features. The Johnson patents, for example, describe some embodiments of a cavitation nozzle that "submerges" the high velocity jet in a liquid while effecting a cleaning operation on a surface. That surface may itself be actually submerged. Alternatively, the high velocity jet is artificially "submerged" by being surrounded by a shroud of the same liquid at low pressure and substantially stationary as compared to the high velocity jet.

SUMMARY OF THE INVENTION

It is acknowledged that some advances in the design of cavitation nozzles have been made in the prior art, as represented by the above patents and papers. There has remained, however, a number of areas of study in which researchers have failed to recognize important effects of different parameters in operating a cavitation nozzle. It is, therefore, an object of this invention to provide an improved cavitation nozzle assembly that provides effective cleaning operations considerably superior to those known previously in this art.

The cavitation nozzle assembly embodied in this invention is simple to use. It can, moreover, be used in a single discharge orifice, or multiple orifice configuration, as desired.

Accordingly, this invention envisages a cavitation nozzle assembly adapted to be connected to a source supplying liquid under super-atmospheric pressure and for discharging a high velocity jet of said liquid with cavitation bubbles therein, the nozzle comprising inter alia; a supply chamber connectible to said source for receiving the liquid therefrom, the chamber including an upstream portion divergent in a downstream direction, a downstream portion convergent in the downstream direction, and a central section of generally constant cross-sectional area interconnecting the divergent and convergent portions, the convergent portion being conical in form and converging to an apex so as to define an enclosed angle of about 65° to 90°; and a discharge orifice at the apex of the convergent portion. The orifice is preferably circular in cross-section with a diameter from about 1.2 mm to about 4.0 mm. The supply liquid undergoes expansion upon passage through the orifice such that cavitation bubbles form in the high velocity jet discharged therefrom.

In one preferred embodiment, the enclosed angle is from 75° to 85°, and the discharge orifice of this nozzle assembly is circular, having a diameter in the range from about 1.6 mm to about 3.0 mm with a length to diameter ratio of about 1.8.

In another preferred embodiment the central section of the supply chamber has a diameter in the range from about 12 mm to about 50 mm.

In a still more preferred embodiment, the converging portion of the supply chamber is defined by a disc-like nozzle element, that most preferably is releasably mounted in the nozzle assembly. Optimally, the nozzle angle is about 80°.

In other preferred embodiments herein, the nozzle assembly is provided with a plurality of discharge orifices symmetrically disposed, with each orifice having a diameter in the range from about 1.2 mm to about 4.0 mm.

These and other features and advantages of this invention will become more apparent from the detailed description below. That description is to be read in conjunction with the accompanying illustrative drawings.

DETAILED DESCRIPTION OF THE PREFERRED EMBODIMENTS

Figure 1:
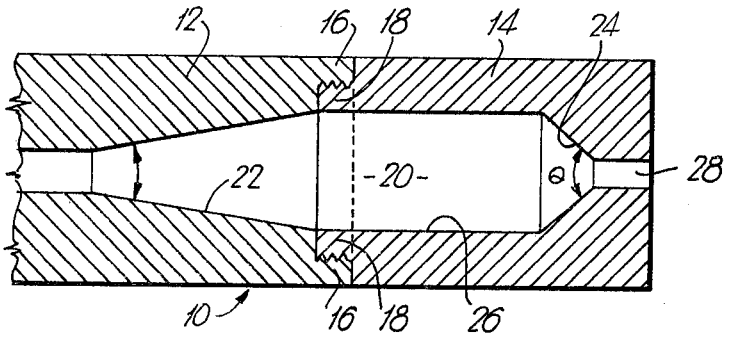
FIG. 1 is an elevation view taken centrally in longitudinal cross-section of a simple nozzle construction embodying the present invention.

A simplified version of a nozzle assembly as envisaged by this invention is shown overall at 10 in FIG. 1. This nozzle assembly 10 includes a two part housing having an upstream part 12 and downstream part 14. These parts are tubular, and preferably, joined releasably together as by threaded connecting portions 16 and 18. The two part housing defines a supply chamber 20 which includes an upstream portion 22 divergent in a downstream direction, a downstream portion 24 convergent in the downstream direction, and a central portion 26 of substantially constant cross-sectional area interconnecting the portions 22 and 24. The surface of convergent portion 24 defines a cone which encloses angle $\theta$ in the range of about 65° to about 90°, more preferably from 75° to 85° and optimally about 80°, and converges to a discharge orifice 28. As suggested by FIG. 1, the orifice 28 actually has a length dimension as well as a diameter, being circular in cross-section. The ratio of length to diameter of the orifice 28 is preferably about 1.8. Further, the diameter of the discharge orifice 28 is preferably in the range from about 1.2 mm to about 4.0 mm.

The part 12 of the nozzle housing is adapted to be connectible to a hose or supply line (not shown) of high pressure liquid, usually water. That supply line is normally of a flexible, reinforced elastomeric material, typically about 9.5 mm (⅜") inside diameter. The liquid is supplied at a pressure up to about 12,000 lb/in$^2$ (80 MPa).

As seen in FIG. 1, the portion 22 of supply chamber 20 diverges slowly, its surface also being conical and typically enclosing an angle of about 10°–20°. If desired optional flow straighteners such as honey-combs or tapered vane-like inserts can be provided in the portion 22 of the supply chamber 20. The inlet to supply chamber 20 is of the same diameter as the inside diameter of the supply line, not shown. The parts 12 and 14 of the nozzle assembly are usually made of metal, for example, stainless steel, with the inlet, supply chamber 20 and discharge orifice 28 being machined therefrom. The actual location of the connecting portions 16 and 18 is not critical. In this version of the nozzle assembly 10 the location is determined more by the resulting ease of manufacture than by other factors.

The basic nozzle assembly 10 is envisaged herein for use primarily in a location actually submerged, e.g., underwater cleaning of a ship's hull, the interior of a tank, underwater parts of a drilling tower, or the like. This is so because, as shown in this art, cavitation nozzles are most effective under water, i.e., submerged. In air, it is likely that cavitation will not suitably occur and instead, the jet will better function on the basis of droplet impact. This can be avoided by artifically submerging the cavitation jet for in-air applications.

Figure 2:
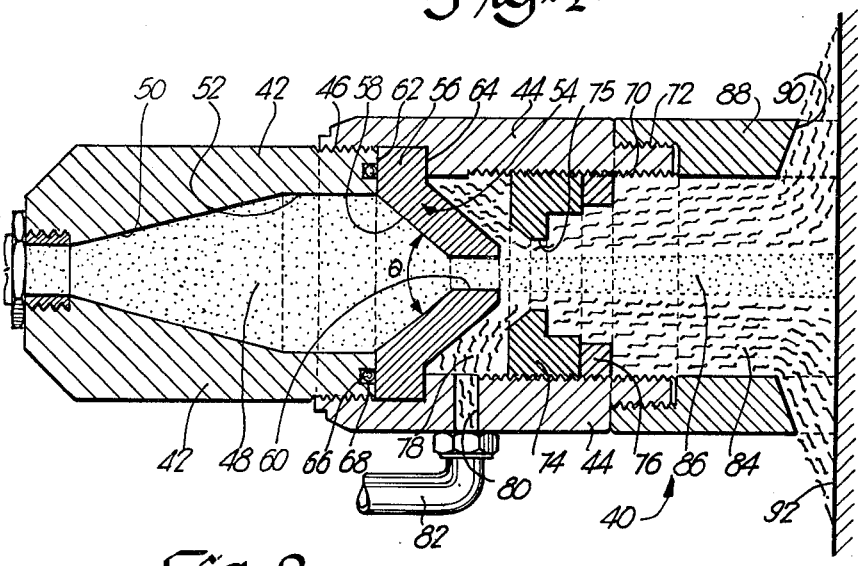
FIGS. 2 and 3 are also elevation views taken in longitudinal cross-section centrally of two preferred embodiments of nozzle assemblies envisaged by this invention.

Turning now to FIG. 2, one embodiment of a more preferred nozzle assembly is shown overall at 40. This nozzle assembly 40 also has a tubular, two-part housing including an upstream part 42 and a downstream part 44. Again these parts 42 and 44 are releasably coupled together by thread means 46. In this instance the particular structure used is for purposes that are evident from the drawing as well as the description further below.

The upstream part 42 defines in the main a supply chamber 48, connectible as before to a source of liquid to be delivered thereto via a rubber hose or the like, not shown. The supply chamber 48 also includes an upstream portion 50 divergent in a downstream direction, and a central portion 52 of generally constant cross-sectional area. In this embodiment, however, the downstream portion is in the form of a disc-like nozzle element 54. This element 54 includes a retaining peripheral flange portion 56 and a central conical portion 58. The conical portion 58 is convergent in a downstream direction and encloses an angle $\theta$ preferably of about 75° to 85°. The conical portion 58 converges to a discharge orifice 60 formed concentrically of the nozzle element 54. The nozzle element 54 is secured removeably in place by having flange portion 56 seated against longitudinally facing shoulders 62 and 64 formed on the housing parts 42 and 44 respectively. An O-ring seal 66 is provided in a suitably formed groove 68 in shoulder 62, to seal the high pressure in supply chamber 48 from the exterior.

As seen in FIG. 2, the downstream half of part 44 is threaded both internally at 70 and externally at 72. The internal threads 70 in this example serve to position a low pressure nozzle shown at 74 with nozzle opening 75 in place slightly downstream of the discharge orifice 60. A locking ring 76 secures the low pressure nozzle 74 in place. It is seen from FIG. 2 that the nozzle 74 forms one side of what might be called a liquid distribution chamber 78, the other sides being formed by the housing part 44 and the downstream, exterior face of the high pressure nozzle element 54. An opening 80 is provided in the housing part 44, and is adapted to be connected to hose means 82 that supplies liquid from a low pressure source (not shown) of the same. The low and high pressure liquids are usually the same, and commonly are water. In this arrangement, low pressure liquid is supplied to the distribution chamber 78 and is discharged through opening 75. A bevelled surface is provided leading to opening 75, and that surface also encloses an angle of 75° to 85°. The low pressure liquid is discharged at low velocity, and thus forms an envelope or shroud shown by the wavy lines 84 completely surrounding a high velocity jet exiting from orifice 60 and shown by the stippled region 86. An optional shroud housing 88 is threadedly coupled to nozzle housing part 44 at 72. Shroud housing 88 has exit openings 90 formed at the free end thereof, and functions to further ensure that the high velocity jet 86 remains submerged, albeit artificially. In this way, cavitation bubbles which form in the jet 86 upon passage through discharge opening 60 are prevented from expanding and collapsing prematurely. It will be evident that the axial length of shroud housing 88 is chosen to optimize the concentration of the cavitation bubbles as they collapse against a workpiece surface 92, obtained by abutting the shroud housing 88 against said workpiece surface.

Our experimental results have shown that with artificial submergence, the cleaning efficiency for normal impact can be improved to the extent of a two-fold increase over the cleaning efficiency of a fully submerged cavitation jet. A four fold increase is obtained over conventional in-air jets (see FIGS. 4–9) and at least a 10 fold increase over conventional jets when used in submerged conditions.

Having referred to experimental results, it will be useful here to describe briefly the procedures followed.

Assessment and ranking of cleaning effectiveness was done primarily on the basis of the depth of crater and the efficiency of penetration (depth of crater/power input to nozzle) resulting from static erosion tests on 1100-F aluminum. Although subsequent, high pressure cleaning tests (POMPA) have confirmed the results. A fixed exposure time of five minutes was normally adopted but some tests were made at one-half, one-, two-, and three-minute intervals. More particularly, measurements taken from the tests with samples of aluminum give the loss of mass, m, and maximum depth of the crater, h, which resulted from a fixed time exposure, T, of the specimen to the high velocity jet. The cleaning tests give the area cleaning rate, A, which is determined from the width of cleaned path, w, and the nozzle translation velocity, s, ($A=w\times s$).

These measurements take no account of the power supplied to the nozzle, which is required when comparing nozzles of different diameter operating at different pressures. For example, a larger diameter nozzle is likely to erode more material or clean a wider path than a smaller one, but the larger nozzle will require more power (power increases as the square of the nozzle diameter). Thus, for the same input power, it might be more efficient to use a number of smaller nozzles sooner than one larger one. An analogy is the comparison of car performances without considering engine size or available power.

The performance parameters selected to account for these factors are erosion efficiency, $e_m$, penetration efficiency, $e_h$, and cleaning efficiency, $e_a$.

Erosion efficiency, $e_m$, is defined as the mass of material eroded by the jet per unit of energy used by the nozzle. Thus $$e_m=m/(WT)$$

where W is the power used by the nozzle (determined from the product of supply pressure and actual flow rate).

Penetration efficiency, $e_h$, is defined as the peak depth of erosion per unit of energy used by the nozzle. Thus $$e_h=h/(WT)$$

Cleaning efficiency, $e_a$, is defined as the rate of area cleaning per unit of power used by the nozzle (or area cleaning per unit of energy used by the nozzle). Thus $$e_a=A/(WT)=(w\times s)/W$$

where A is the area cleaned in time T.

These three performance parameters can all be used to determine nozzle rankings.

Approximately 2500 tests were made on 60 different nozzle designs in submerged, artificially submerged, and in-air conditions. Supply pressures were from 8–80 MPa, nozzle diameters from 0.4–4 mm over 0–50 cm standoff distances. Conditions for suitable submergence were investigated by varying the position, shape and diameter of the low pressure nozzle 74 and its opening 75 and the shroud-water supply pressure. In some tests the shroud housing 88 was used in conjunction with the low pressure nozzle 74.

A series of tests was also conducted with the axis of the high velocity jet inclined from a position normal. Tests were made with the jet inclined at 15, 30, 45 and 60 degrees from the normal testing position. In this latter case the results showed that for a 3.2 mm diameter artificially submerged and fully submerged jet, an increase in the depth of penetration is obtained as the angle of inclination is increased. The maximum depth of penetration occurs at an angle of 45° (for both 5 and 15 cm standoff distances) and is approximately double that of normal (90°) impact. Additional tests were conducted with a one-half minute and one minute exposure times for normal, i.e., 90° and 45° inclined jets with similar results.

The maximum values of mass loss, erosion efficiency, depth of penetration and penetration efficiency at the optimum standoff distance for the various conical angled, hemispheric and logarithmic nozzles, 20 MPa submerged are summarised in FIGS. 4 to 7.

Figure 11:
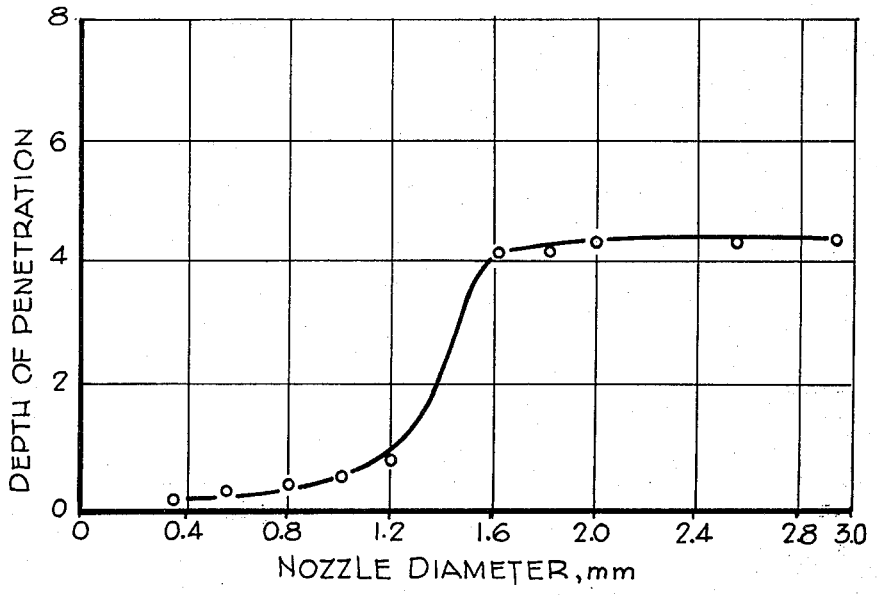

Of all the types considered, the 80 degree included-angle conical nozzle was surprisingly found to be the best. There is a factor of two to three in performance between the 80° conical and the 112°, 140°, 180° conical and logarithmic nozzles. The 112° conical and logarithmic nozzles are those given as optimum in current literature. Note the results on nozzle diameter (FIGS. 11, 12) which show that cavitation damage is critically reduced at nozzle diameters below about 1.2 mm.

For effective protection of the cavitation jet, when used in air operations the supply pressure of the water surround jet has to be at a pressure of about 0.2 MPa or greater. We also found that the actual shape of the low pressure nozzle 74 has little effect on the performance of the high velocity cavitation jet. Similarly, a standard nozzle-to-nozzle clearance spacing axially of about 3.0 mm was adopted. That occurred after it became clear that unless the clearance was below 1 mm the spacing also has little effect on the action of the cavitation nozzle 54, and then an adverse effect.

Figure 3:
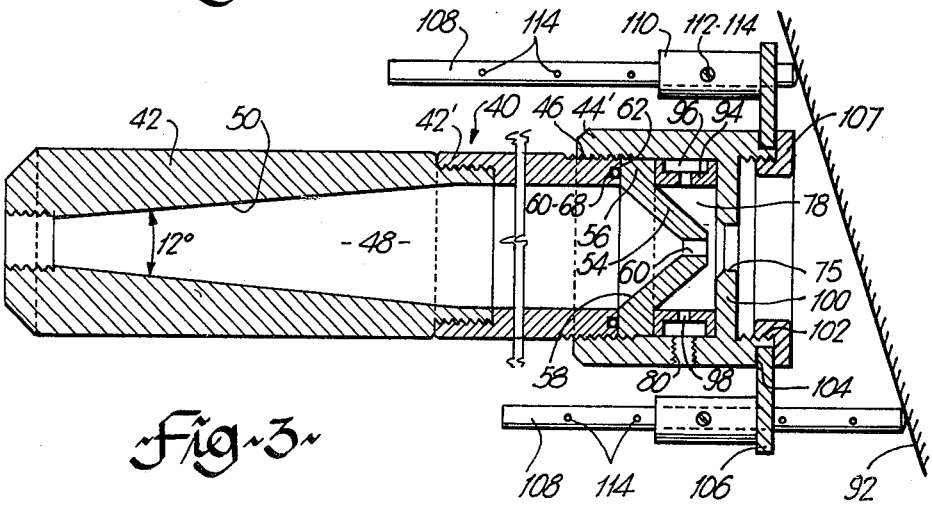
Figure 4:
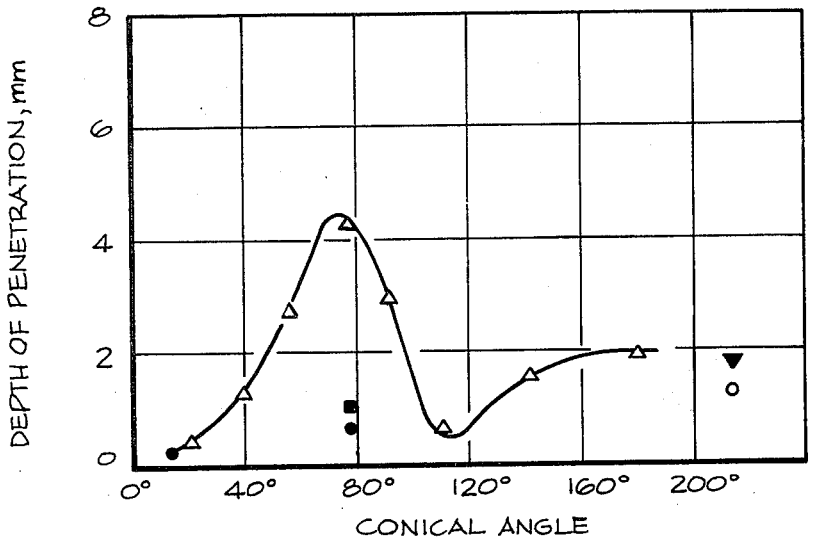
FIGS. 4 to 12 inclusive are graphical representations to show various factors such as penetration, penetration efficiency, mass loss and mass loss efficiency, measured against conical angle, supply pressure, and orifice diameter in nozzle structures encompassed herein.
Figure 5:
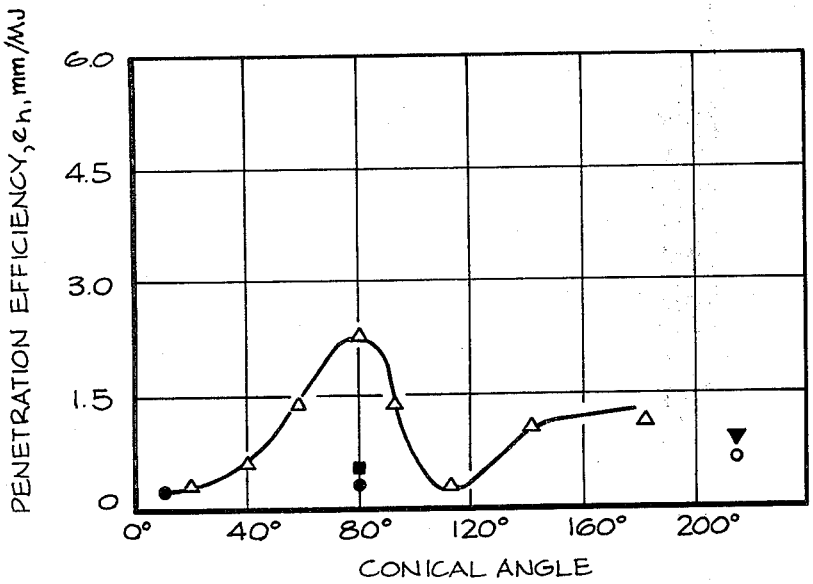
Figure 6:
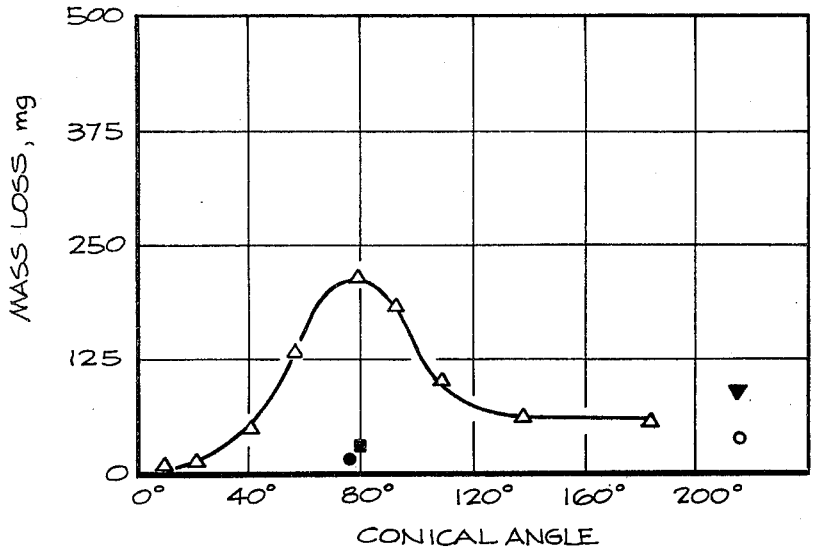
Figure 7:
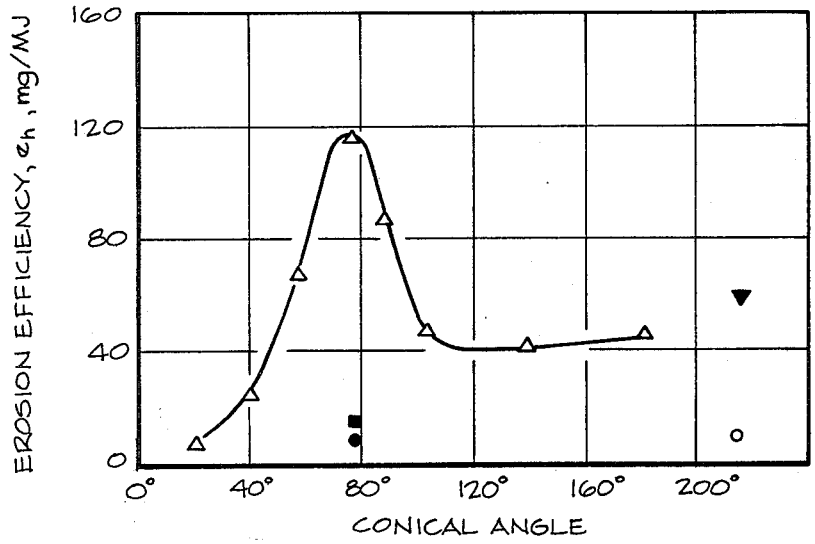
Figure 8:
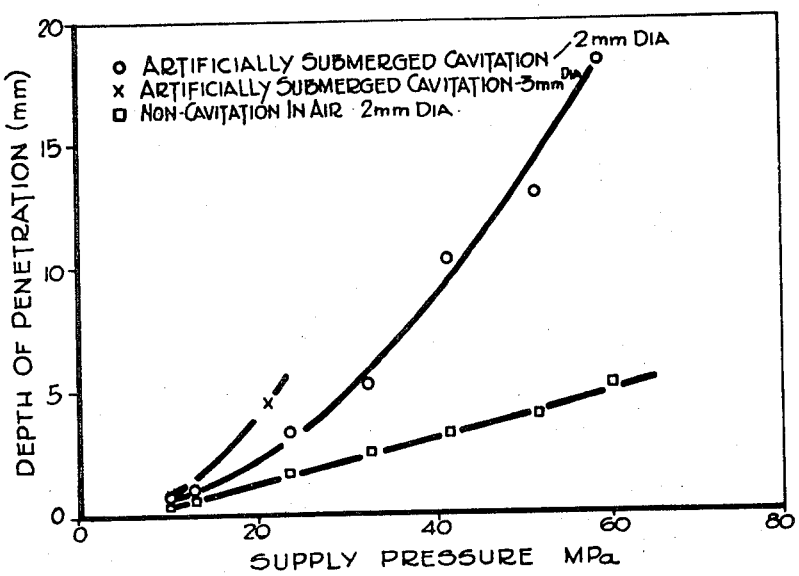
Figure 9:
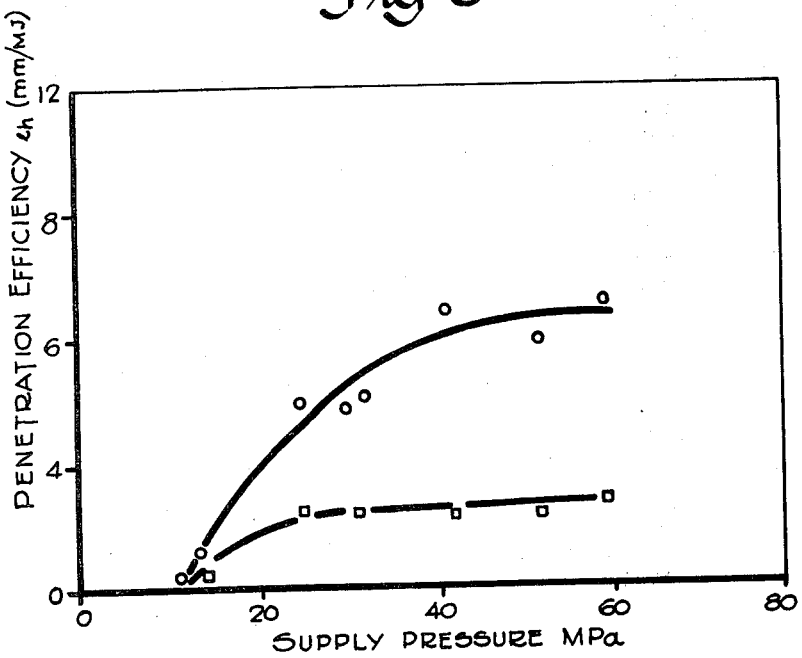
Figure 10:
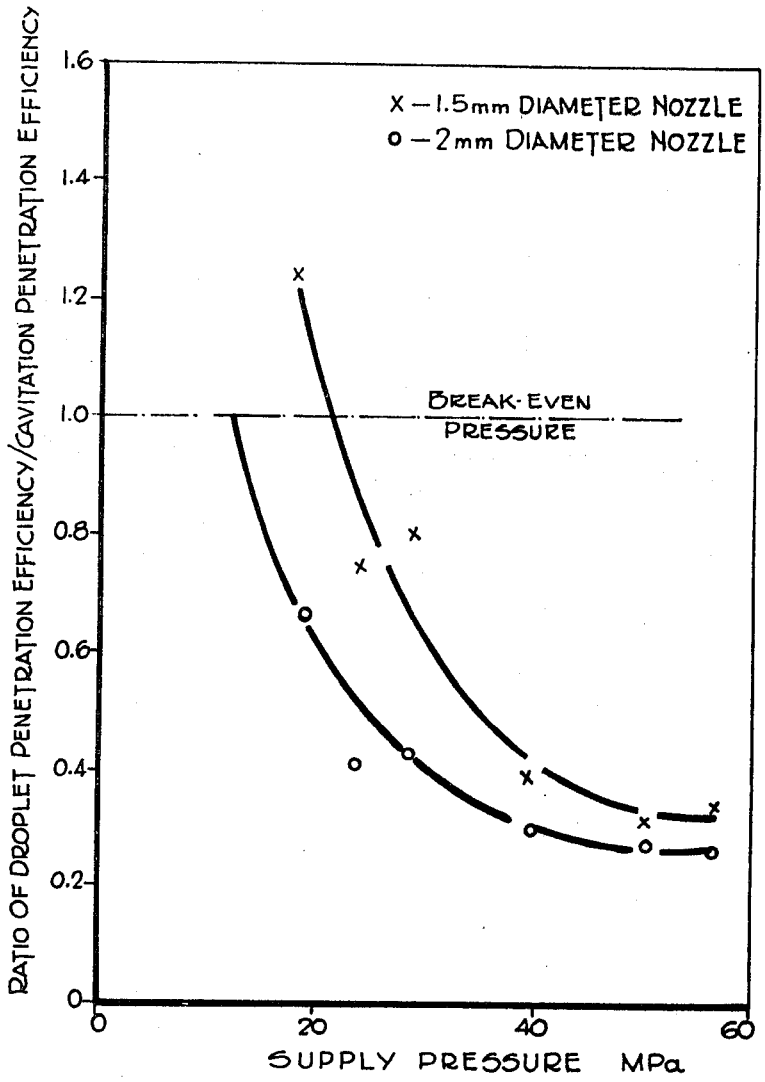

Returning now to the drawings herein, FIG. 3 illustrates an embodiment of a nozzle assembly which is quite similar to that of FIG. 2. Corresponding parts in FIGS. 3 and 2, therefore, are identified by the same reference numeral in each figure. There are certain differences. For example, the upstream housing part 42 includes an intermediate section 42'. The upstream part in FIG. 3, therefore, is sectional as compared to the single construction illustrated in FIG. 2. This is clearly a matter of choice, and may depend on the method of manufacturing.

As in FIG. 2, the disc-like nozzle element 54 defines the downstream end of the supply chamber 48. Further, that nozzle element is removeably secured and sealed against the shoulder 62 of the upstream housing part 42 (42'). In FIG. 3, however, the peripheral flange portion 56 serves to support liquid distribution means in the form of a distributing ring 94. The ring 94 has a U-shaped cross-section, with a radially outwardly facing channel 96 being shown. A multiplicity of radially extending boreholes 98 connect the channel 96 with the chamber 78 which surrounds the high pressure discharge orifice 60.

The downstream part is marked 44', since it not only contains inlet opening 80, but also a radially inwardly extending retaining flange 100 and internally located screw thread 102. The distributing ring 94 is releasably secured in place between retaining flange 100 and flange 56, when the parts 42' and 44' are coupled together. It is noted here that flange 100 also defines the low pressure nozzle opening 75, again with a 75°–85° bevel facing upstream. FIG. 3 also shows the delivery opening 80 for low pressure water in the downstream part 44', to supply water to distributing channel 96.

The housing part 44' is further modified by having at its downstream end an outwardly facing shoulder 104. This shoulder or check 104 extends peripherally of the part 44'. Positioning means in the form of a base ring 106 and adjustably mounted legs 108 are supported from the shoulder 104. A lock nut 107 secures the base ring 106 in place by engaging threads 102. Legs 108 are retained in corresponding bosses 110 secured, for example by spot welding, at predetermined locations on the base ring 106. Each boss 110 has at least one borehole 112 therein extending diametrically through the same. Each leg 108 has a plurality of corresponding boreholes 114 spaced at predetermined locations longitudinally thereof. Locking means in the form of a pin or set screw is inserted into the appropriate borehole 114. This has the effect, when legs 108 are firmly seated against a workpiece surface, of positioning the high pressure discharge orifice 60 a predetermined standoff distance from said surface. With three symmetrically located legs 108 provided, along the lines of a tripod, one leg can be positioned at a shorter height such that the high velocity jet with cavitation bubbles therein is directed at the work surface at an angle. As noted above, the angle of impingement of that jet is preferably from about 30° to about 60°, with optimum results being obtained at about 45°.

Figure 12:
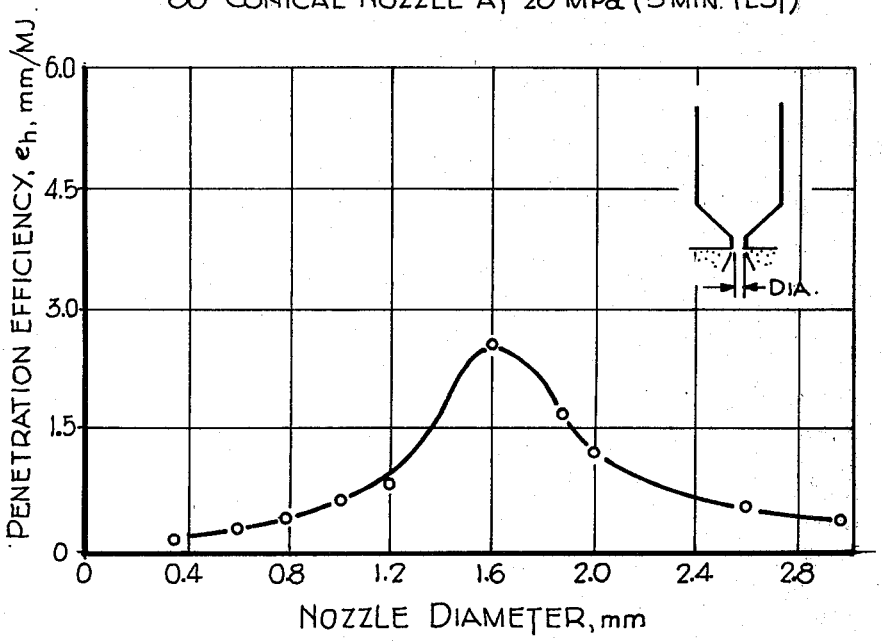

In a further embodiment herein, we have combined a plurality of discharge orifices to form a multi-nozzle cleaning head. Thus, it is proposed that a multi-orifice cavitation nozzle would have a converging conical portion, convergent in the downstream direction and enclosing an angle in the range from 65° to 90°, more preferably from about 75°–85°, and optimally at about 80°. This conical portion is truncated at a downstream face in which the plurality of discharge orifices are provided. These orifices will usually be symmetrically positioned with respect to the axis of the conical portion, either in a line to produce a fan-shaped "spray" i.e, a high velocity jet; or at radially equidistant locations. In this way an optimized nozzle configuration will be seen to use discharge openings of 1.6 mm diameter (the diameter for optimum efficiency as seen in FIG. 12) with an enclosed angle of about 80° (from FIGS.4–7). To accommodate a desire, say, for increased flow rates that might be available in a given situation, an increased number of discharge openings would be provided in the one cleaning head. In other words, although higher pressures and larger orifice diameters could be used it would be most efficient to use a multi-orifice cavitation nozzle in which the angle and orifice diameter were optimized. As seen from FIG. 9, increasing the supply pressure beyond about 40–60 MPa provides only a limited gain.

The power requirement for a multi-nozzle with n holes of diameter D is given by $$W = n\, C_D D^2 \pi 2^{-3/2} \rho^{-\frac{1}{2}} p^{3/2}$$

where $C_D$ is the overall discharge coefficient and $\rho$ is the density of the water.

I p is in lb/in$^2$, D in inches this becomes for water $$W = 0.0173989\, n\, C_D D^2\, p^{3/2}$$

where W will be in HP

Thus a single nozzle of diameter $D_1$ and discharge coefficient $C_{C1}$ has the same power requirements as a multi-nozzle consisting of n holes of diameter D and discharge coefficient $C_D$ if $$n = (C_{D1} D_1^2)/(C_D D^2)$$

There is no sensible limit to the number of holes that can be made in a multi-nozzle cleaning head but restrictions on the operator reaction force, or the level of water, or power supply, may in practice restrict this number.

The foregoing has described a cavitation nozzle assembly which improves considerably the cleaning and erosion effects obtained, compared to prior art designs. Some alternative configurations have been shown, for example, for replaceability of consumable nozzle elements, or interchangeability to vary discharge orifice diameters, or numbers. It is therefore intended herein to encompass all such configurations and features apparent to persons skilled in the art, which fall within the claims below.

The embodiments of the invention in which an exclusive property or privilege is claimed are defined as follows:

1. A cavitation nozzle assembly adapted to be connected to a source supplying liquid under superatmospheric pressure and for discharging a high velocity jet of said liquid with cavitation bubbles therein, said nozzle comprising inter alia;

a supply chamber connectible to said source for receiving said liquid therefrom, said chamber including an upstream portion divergent in a downstream direction, a downstream portion convergent in the downstream direction, and a central section of generally constant cross-sectional area interconnecting the divergent and convergent portions, said convergent portion being conical in form and converging to an apex so as to define an enclosed angle of about 65° to 90°; and a discharge orifice at the apex of the convergent portion, and being circular in cross-section with a diameter in the range from about 1.2 mm to about 4.0 mm, said supply liquid undergoing expansion upon passage through said orifice such that cavitation bubbles form in the high velocity jet discharged therefrom.

2. The nozzle assembly defined in claim 1, wherein said convergent portion converges to a discharge orifice having a diameter in the range from about 1.6 mm to about 3.0 mm with a length to diameter ratio of about 1.8.

3. The nozzle assembly defined in claim 1, wherein said enclosed angle is from 75° to about 85°, and liquid distributor means are provided for developing a shroud of said liquid at a pressure lower than that in the supply chamber, said shroud substantially completely surrounding the high velocity jet of said liquid.

4. The nozzle assembly defined in claim 1, 2 or 3 wherein said central section has a diameter in the range of about 15 mm to about 50 mm.

5. The nozzle assembly defined in claim 1, wherein the converging portion of the supply chamber is defined by a disc-like nozzle element.

6. The nozzle assembly defined in claim 5 wherein the nozzle element is releasably secured, and defines a downstream end of the supply chamber.

7. The nozzle assembly defined in claim 3, wherein said distribution means supplying said shroud of liquid is in the form of a distribution collar, said collar being removeably retained in a housing and defining therewith an annular region of liquid at the lower pressure, said annular region being located generally concentrically of the nozzle element, said collar having flow channels therein to enable the formation of said shroud of low pressure liquid surrounding the high velocity jet.

8. The nozzle assembly defined in claim 1 wherein said divergent upstream portion has its longitudinal axis at least substantially parallel to the axis of said convergent downstream portion.

9. The nozzle assembly defined in claim 8 wherein the axes of said divergent upstream portion, said central section and said convergent downstream portion are in coaxial alignment.

10. The nozzle assembly defined in claim 1 wherein the diameter of said discharge orifice is about 1.6 mm, said enclosed angle is about 80°, and said central section has a diameter in the range of about 15 mm to about 50 mm.

11. A cavitation nozzle assembly adapted to be connected to a source supplying liquid under superatmospheric pressure, and operable to discharge a high velocity jet of said liquid with cavitation bubbles therein, said nozzle assembly comprising, inter alia;

an inlet housing adapted to be connected to said source of liquid, and defining an inlet channel, an upstream portion of a chamber, divergent in a downstream direction and connected to the inlet channel, and a central section of the chamber, of generally constant cross-sectional area;

a terminal housing of generally tubular form, having an open upstream end and a downstream end having radially inwardly extending flange means to define an exit for the high velocity jet, said terminal housing being secured to the inlet housing, said terminal housing also including liquid distribution means connectible to a supply of liquid at a pressure lower than that of said source and configured to provide a shroud of liquid surrounding said high velocity jet upon discharge from said nozzle assembly; and a disc-like nozzle element having a conically formed central portion configured to enclose an angle in the range of about 75° to 85°, said central portion converging to define a discharge orifice, with the nozzle element being releasably retained by the inlet and terminal housings and positioned such that the central portion of said nozzle element converges in a downstream direction.

12. The nozzle assembly defined in claim 11, wherein said central section of the chamber is of a diameter in the range of about 15 mm to about 50 mm.

13. The nozzle assembly defined in claim 11 or 12 wherein said discharge orifice has a diameter in the range from about 1.2 mm to about 4.0 mm.

14. The nozzle assembly defined in claim 1, 11 or 12, wherein a plurality of discharge orifices are provided, symmetrically disposed about a vertical apex of the converging portion.

15. The nozzle assembly defined in claim 1, 11 or 12, wherein a plurality of discharge orifices are provided, symmetrically disposed about a virtual apex of the converging portion, each of such orifices being in the range from about 1.5 mm to about 3.0 mm.

16. The nozzle assembly defined in claim 11, or 12, wherein said liquid distribution means is in the form of a bobbin-like tubular collar having radially outwardly extending flange means at upstream and downstream ends thereof, there being flow channels through a body portion of the collar to enable development of said shroud of low pressure liquid.

17. The nozzle assembly defined in claim 11 or 12, wherein said liquid distribution means in in the form of an annular chamber formed generally concentrically of the nozzle element, there being flow directing means operatively associated with said annular chamber to enable formation of said shroud of liquid at low pressure, surrounding the high velocity jet.

* * * * *